US005214883A

United States Patent [19]

Naumec et al.

[11] Patent Number: 5,214,883

[45] Date of Patent: Jun. 1, 1993

[54] METHOD AND APPARATUS FOR PROCESSING ARTICLES REQUIRING A SURFACE FINISH

[75] Inventors: John R. Naumec, Willimantic; Joseph E. Faucher, East Hartford, both of Conn.

[73] Assignee: United Technologies Corporation, Hartford, Conn.

[21] Appl. No.: 914,484

[22] Filed: Jul. 15, 1992

Related U.S. Application Data

[63] Continuation of Ser. No. 609,865, Nov. 7, 1990, abandoned.

[51] Int. Cl.[5] ..... B24B 31/02

[52] U.S. Cl. ..... 51/164.1; 51/163.1; 51/317

[58] Field of Search ..... 51/7, 16, 17, 19, 20, 51/163.1, 164.1, 313, 315, 316, 317

[56] References Cited

U.S. PATENT DOCUMENTS

| | | | |
|---|---|---|---|
| 731,092 | 6/1903 | Baker | 51/164.1 |
| 2,760,504 | 8/1956 | Spurlin | 134/132 |
| 3,194,385 | 7/1965 | Barnese | 198/64 |
| 3,232,492 | 2/1966 | Carrier, Jr. | 222/161 |
| 3,965,620 | 6/1976 | Dreher | 51/164.1 |
| 3,991,524 | 11/1976 | Ferrara | 51/163.1 |
| 4,245,737 | 1/1981 | Pellerin et al. | 198/756 |
| 4,763,772 | 8/1988 | Gradoboev | 198/398 |
| 4,987,702 | 1/1991 | Anschutz | 51/164.1 |

FOREIGN PATENT DOCUMENTS

| | | | |
|---|---|---|---|
| 376388 | 11/1984 | Fed. Rep. of Germany . | |
| 66853 | 10/1980 | Japan . | |
| 1450985 | 1/1989 | U.S.S.R. | 51/163.1 |
| 934150 | 8/1963 | United Kingdom . | |

OTHER PUBLICATIONS

Mass Finishing (mfsa) pp. (index) 4–19, 36–43, Ultramatic Equipment Co.

SME Paper "Quality Vibratory Finishing: Preparing for SPC", by Samuel R. Thompson.

*Primary Examiner*—J. J. Swann

*Attorney, Agent, or Firm*—Gene D. Fleischhauer

[57] ABSTRACT

An apparatus 10 and method for providing a surface finish to articles 12 is disclosed. Various constructions and details are developed which promote the adaptability of the device and method to use in automated facilities employing flow lines to process articles. In one particular embodiment, articles 12 are disposed in predetermined volumes of finishing media 30 which are separated from each other, the finishing media being vibrated as the media is urged along a surface 58 from one location to another by a helicoid-type blade 66. In one embodiment, a media vibrator vibrates the surface 58 to vibrate the media. Any suitable device may be used to provide vibrational energy to the surface.

7 Claims, 4 Drawing Sheets

METHOD AND APPARATUS FOR PROCESSING ARTICLES REQUIRING A SURFACE FINISH

This is a continuation of application Ser. No. 07/609,865 filed on Nov. 7, 1990, now abandoned.

TECHNICAL FIELD

This invention relates to a processing apparatus for providing a surface finish to articles, such as turbine blades. The invention particularly relates to performing such a process as part of a flow line which requires movement of the parts from one location to another to perform operations on the parts. This apparatus was developed in connection with the fabrication of components in the gas turbine engine field, but has application to fabricating components in other fields.

BACKGROUND OF THE INVENTION

Castings for turbine blades are one example of an article which requires a surface finish. Such articles are commonly finished in vibratory environments.

A vibratory environment for providing a finish generally consists of a casing or tub, a volume of media which is sufficiently large to reduce the possibility of contact between articles disposed in the media and the articles themselves disposed in the media. The tub or casing is vibrated, causing the media to vibrate and circulate with respect to the article. The media exerts a frictional force on an area of the article which when coupled with relative movement between the article and media does work on the articles disposed in the media. For casings, the casing extends longitudinally. Media and articles are fed in at one end and are flowed through the casing much as water and small stone flow through a pipe. This causes the height of the media to vary with length and provides uncertainty as to the finish which is provided.

Processing articles in a tub or casing with other articles has another significant disadvantage. It is possible for one article to strike an adjacent article even though the statistical probability of such an event is small. In the case of turbine blade castings (hereafter referred to as turbine blades), such contact is particularly troublesome because of the high standards of quality which the blades must meet. A small scratch or nick in a turbine blade, which might be acceptable in another type of article, may cause scrapping of a casting which cost many hundreds of dollars to fabricate because of the tight tolerances required for the cast article.

Processing articles in a tub has an added disadvantage. Typically the machine is shut down after a sufficient processing time has elapsed to provide an adequate surface finish to the articles. This is followed by removing the articles from the tub and transporting the articles to the next location, all of which may inadvertently cause contact between turbine blades and result in nicks and scratches which require discarding the turbine blade.

Accordingly, scientists and engineers working under the direction of Applicants' assignee have sought to develop a vibratory finishing process which would eliminate or decrease the possibility of blade to blade contact and decreases the amount of handling the turbine blade casting experiences after the blade is finished while it is being moved to the next location.

DISCLOSURE OF THE INVENTION

According to the present invention, a plurality of articles are surface finished while being conveyed between two locations by 1) disposing the parts in successive predetermined volumes of carrier media for carrying the parts in a spaced apart relationship, 2) urging the media along a predetermined path extending between the two locations, and 3) vibrating the media with respect to the article as the media and the article are moved between the two locations In accordance with one detailed embodiment of the present invention, an apparatus for providing a surface finish to an article includes a surface for supporting finishing media, successive volumes of finishing media disposed on the surface which are separated one from the other and are of a predetermined size, each volume of media carrying an article which requires a surface finish, and means for urging the article along the surface and for vibrating the media with respect to the article. In one particular embodiment, the surface is an inner portion of a casing having disposed therein a helicoid-like blade, the casing and blade being vibrated while the blade is rotated to move each volume of media carrying the article along the surface of the casing.

A primary feature of the apparatus of the present invention is both the finishing media and a carrier for articles disposed in the media. Another feature is a conveyor having a surface and a helicoid-type blade for urging the media along the surface from one location to another. Another feature is the predetermined volumes of media spaced along the screw conveyor. Another feature is a resilient seal which extends between the blade and the surface and which blocks movement of media between adjacent volumes. The screw conveyor has chambers formed by the bottom of the blade of the screw conveyor and the surface of the screw conveyor. The predetermined volumes of media are disposed in each chamber. In one embodiment, a feature is means for imparting vibrations to the screw conveyor. In one embodiment, a feature is a resilient surface formed by a resilient coating applied to the blade, to the shaft which supports the blade and to the inner surface of the casing to provide resilient surfaces for protecting the article from contact with hard surfaces.

A primary feature of the method of the present invention is the step of carrying the article to be finished in finishing media at a predetermined rate from one location to another as the media is vibrated to finish the article. Another feature of this method is disposing predetermined, successive volumes of media on a surface and moving the successive volumes of media in sequential fashion along the surface. In one embodiment, a feature of the method is blocking the media from moving from one volume of media to the adjacent volume of media.

A primary advantage of the present invention is the avoidance of damage to articles as they move through a vibratory device for providing a finish to the article which results from carrying a limited number of articles in each discrete volume of media; and, the possibility of an article striking the adjacent article is eliminated by carrying only one article in each volume of media. Another advantage of the present invention is the efficient use of time and space for a method of finishing an article which provides a predictable level of finish for the article while transporting the article between two locations at a predetermined rate for a given volume of media. The method is particularly advantageous in flow line applications and in applications where automatic machinery is used to handle the article in successive steps during fabrication of the finished article. Another advantage of the present invention is the continuous nature of the process and the predictable level of finish which results from using a helicoid-type blade to urge the media and the article in the proper direction. In one embodiment, the efficiency of the device is enhanced by the media climbing the wall in the same direction of rotation as the blade, the media exerting a frictional force on the surface of the helicoid-type blade and urging the helicoid-type blade to rotate about its axis. Another advantage is the effectiveness, life and replaceability of a flap-type resilient seal disposed between the helicoid-type blade and the resilient surface of the casing.

The foregoing features and advantages of the present invention will become more apparent in light of the following detailed description of the best mode for carrying out the invention and the accompanying drawings.

BEST MODE FOR CARRYING OUT THE INVENTION

Figure 1:
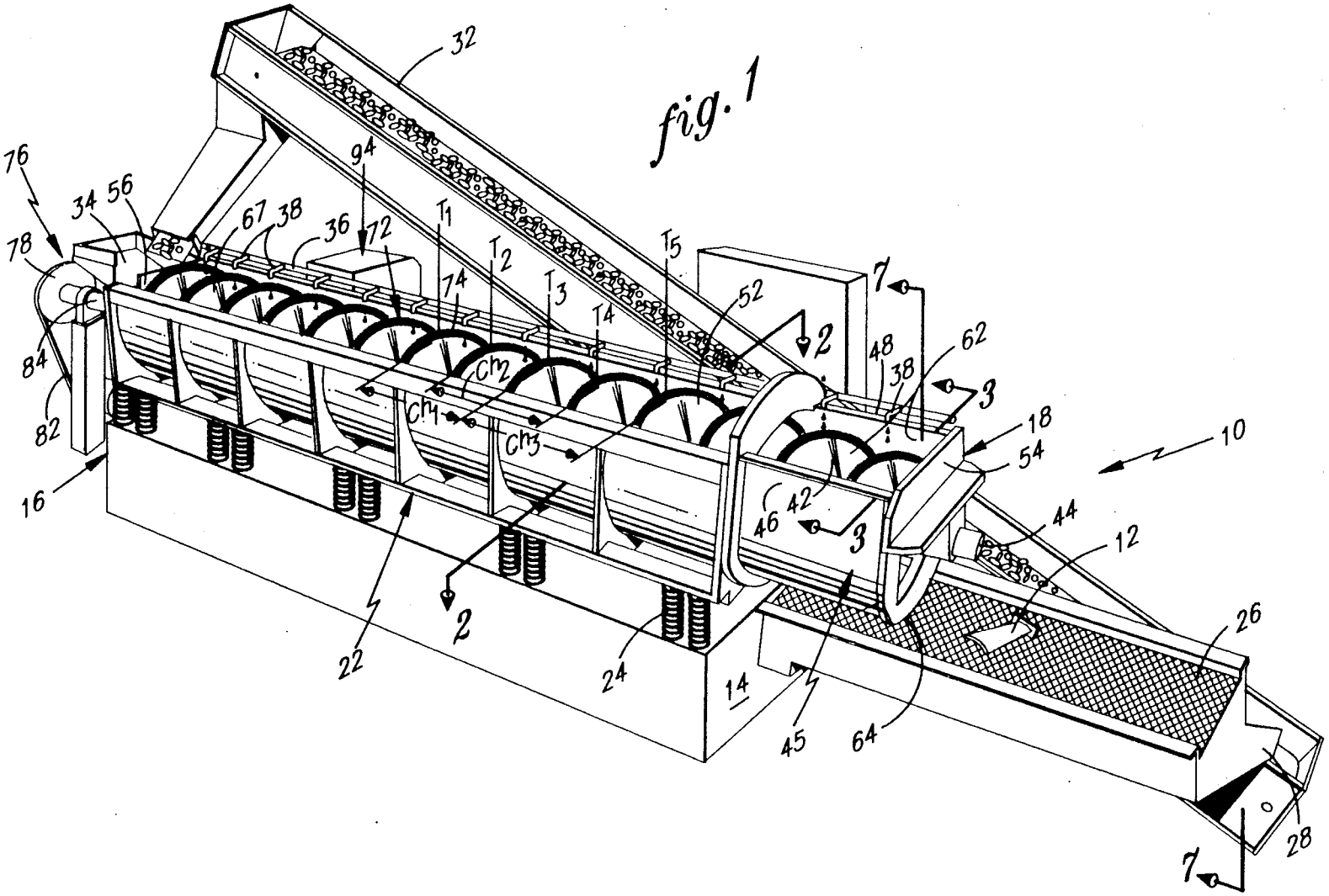
FIG. 1 is a side elevation view of an apparatus for providing a finish to articles as the articles are transported from one location to a second location.

FIG. 1 is one embodiment of the present invention employing a conveyor type apparatus 10 for applying a finish to a plurality of articles, such as a plurality of castings for turbine blades 12. The apparatus has a base 14, a first end 16 at a first location and a second end 18 at a second location.

A screw conveyor 22 extends between the ends 16, 18. Means are provided for elastically supporting the screw conveyor, as represented by a plurality of springs 24, extends between the base 14 and the screw conveyor.

Means are provided for receiving finishing media and a turbine blade from the screw conveyor and separating the blade from the media, as represented by the vibrating screen 26 and chute 28. The screen and chute are in flow communication with the second end 18 of the screw conveyor.

Means are provided for returning the finishing media to the first end of the apparatus for re-use in subsequent volumes of media, as represented by the belt conveyor, extends from the chute to the first end of the screw conveyor.

Means are provided for supplying predetermined volumes of media to the screw conveyor and for receiving media from the belt conveyor. One example of such means is the inlet hopper 34 attached to the first end of the casing. The inlet hopper has a predetermined volume. As the finishing media fills the hopper a level sensor (not shown) determines when a predetermined height of media is reached. An article to be finished, such as the turbine blade, is automatically dropped into place (such as by a robot, not shown) and the hopper is opened to discharge the media and the turbine blade into the first end 16 of the screw conveyor.

Means are provided for providing fluid at spaced apart locations on the screw conveyor 22 as represented by the pipes 36, are in fluid communication with a source (not shown) of finishing compound and solvent, such as water, for diluting of the finishing compound. The means for supplying fluid to the screw conveyor has a plurality of outlets 38 for providing the fluid at a predetermined rate (usually a trickle) to the screw conveyor.

The screw conveyor has an auger 42 having a shaft 44 which extends axially. A casing 45 is disposed about the shaft. The casing is attached to the springs 24. The shaft has an axis of rotation $A_r$.

The casing 45 extends longitudinally. The casing has a first sidewall 46 and a second sidewall 48 spaced laterally from the first sidewall leaving an opening or cavity 52 therebetween. A first end member 54 and a second end member 56 extend laterally between the sidewalls to rotatably engage the axially extending shaft 44. The casing has an inner surface 58 formed by a coating of resilient material. The resilient material also coats the auger to provide a resilient surface 62 to the auger. One example of a satisfactory material is a Urethane coating available from the Ultramatic Equipment Company, 848 Westgate Drive, Addison, Ill., which provides a coating at the time of manufacture of the casing. The Urethane coating has a durometer (hardness) reading of 90.

A bottom section 64 extends circumferentially about the axis $A_r$ from the first sidewall 46 to the second sidewall 48. The bottom section has a cylindrical shape over an arc which is less than or equal to one-hundred eighty degrees. The sidewalls and bottom section are formed as a single piece or may be joined so that the sidewalls and bottom section are integral with each other. The bottom section and sidewalls form the open trough-like casing for receiving predetermined volumes of media 30 and the turbine blade 12 and for supporting the media 30 and turbine blade as the media carries the turbine blade through the screw conveyor.

The auger 42 rotatably engages the end sections of the casing. The auger has a helicoid-like blade 66 integral with the shaft 44 that is, generally having a spiral or helicoid shape, including spiral shapes having variations in height or spacing between crests $T_1$, $T_2$, etc. The helicoid-like blade extends axially through the casing with its plurality of crests $T_1$, $T_2$, $T_3$, $T_4$ and $T_5$. A spiral-like groove extends between the crests of the blade. As will be shown in connection with FIG. 2, the bottoms 68 of the blade in combination with the bottom of the casing forms a plurality of chambers, as represented by the chambers $Ch_1$, $Ch_2$, $Ch_3$.

A resilient seal assembly 72 extends from the helicoid-like blade 66 to the inner surface 58 of the casing over at least the arcuate portion of the casing. The seal has a plurality of individual seal elements 74.

Means 76 are provided for rotating the auger 42 at a predetermined speed. It is disposed at the first end 16 of the apparatus 10 and is drivingly attached to the shaft 44 of the auger. The means for rotating the auger might include, for example, a toothed gear 78, a chain 82 which engages the toothed gear, and a means for driving the chain such as a motor (not shown). A shaft 84 extends from the toothed gear. A double universal joint (not shown) is attached to the shaft of the toothed gear and the shaft of the auger. The universal joint accommodates misalignment of the two shafts as might occur during vibratory movement of the screw conveyor. The means for rotating the auger also acts as a brake by transmitting a retarding force to the shaft of the auger should that be necessary to control the speed of the auger.

Figure 2:
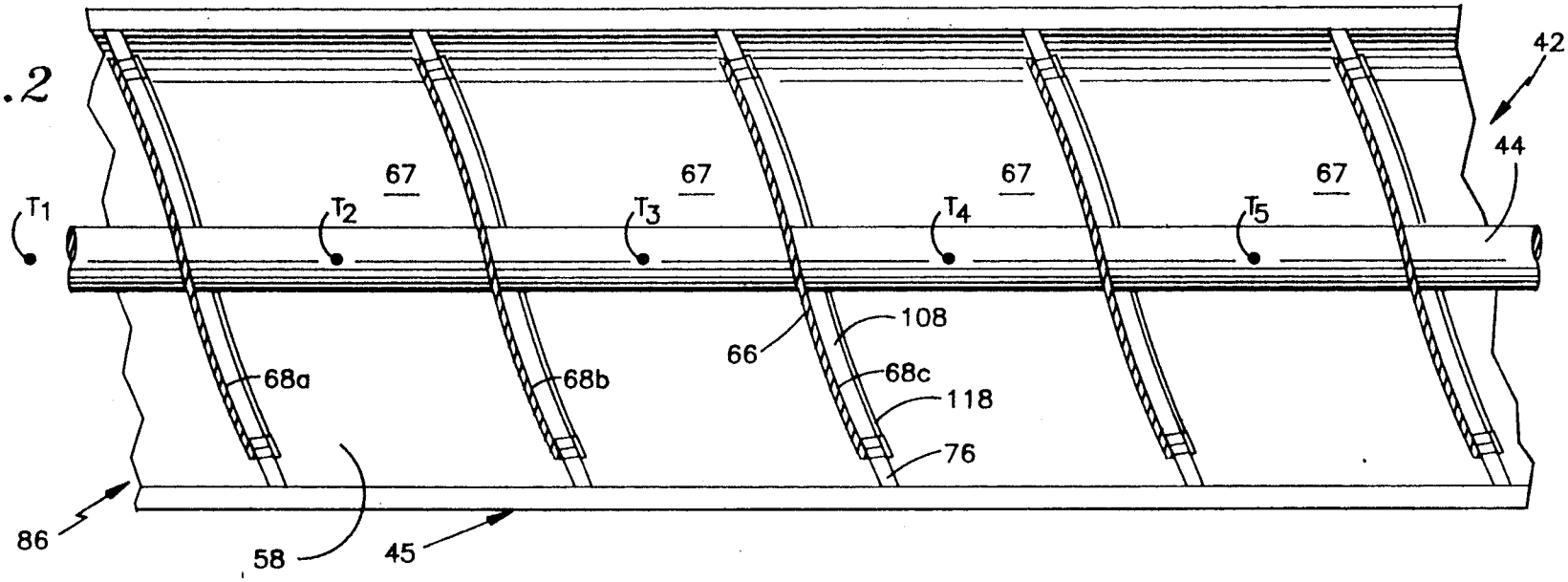
FIG. 2 is a view taken along the lines 2—2 of FIG. 1 partly in cross-section and partly broken away.

FIG. 2 is a section taken along the lines 2—2 of FIG. 1 with a portion of the structure broken away for clarity to illustrate the relationship between the bottoms 68 of the helicoid-type blade 66 and the bottom portion 86 of the casing. As shown in FIG. 1 and FIG. 2, the helicoid-like blade has a plurality of crests $T_1$, $T_2$, $T_3$, $T_4$, $T_5$ and the spiral-like groove 67 which extends between the crests of the blade. The portion of the blade at the bottom 68 of the blade between each crest and the next two adjacent crests (for example $T_1$, $T_2$, $T_3$) form two angularly extending ends 68*a* and 68*b* to chamber $Ch_1$. Each chamber adapts the screw conveyor to receive a predetermined volume of finishing media 30 which is disposed in each chamber. The sides of the chamber are bounded by the bottom portion 86 of the casing 45 adjacent to the chamber which extends between the ends of the chamber. In a like manner, the port ion of the bottom 68*b* of the blade between the crests $T_2$ and $T_3$ and 68*c* between the adjacent pair of crests $T_3$ and $T_4$ define the adjacent chamber $Ch_2$. Thus the helicoid-type blade and the casing define a plurality of separate chambers at the bottom portion of the casing and the bottom portion of the blades.

The resilient seal assembly 72 extends in a generally radial direction from the helicoid-type blade 66 and between the blade 66 and the inner surface 58 of the casing to engage the bottom portion of the casing 45.

Figure 3:
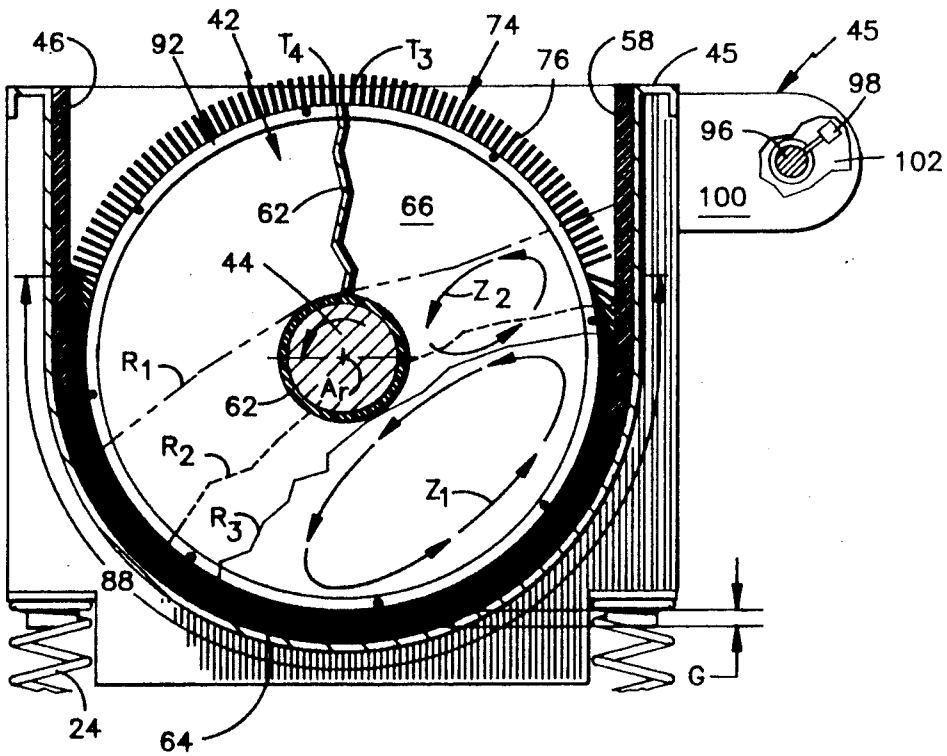
FIG. 3 is a view generally taken along the lines 3—3 of FIG. 1 illustrating circulation zones in different levels of media with portions of the apparatus broken away for clarity.

FIG. 3 is a section taken generally along the lines 3—3 of FIG. 1 with a portion of the helicoid-type blade 66 broken away to show two adjacent crests $T_3$, $T_4$ of the blade and the relationship of the resilient seal assembly 72 and its seal elements 74 to the casing 45.

As shown in FIG. 3, the seal assembly 72 extends between the blade and the casing. The blade is a rotating member having an axis of rotation $A_r$. The casing is a non-rotating member but is capable of movement with respect to the blade because of the different effects of inertia loads on the casing and on the auger.

The casing has a sealing region 88 which is spaced from the blade in a radially oriented direction leaving a clearance gap G therebetween. The gap G may vary under operative conditions of the machine depending, for example, on whether the vibrations in the auger 42 are in phase with the vibrations in the casing 45.

The blade 92 has a rim. The seal assembly has a plurality of seal elements 74 extending radially outward from the blade. Each seal element is made of a resilient material which slidably engages the sealing region of the casing. Each seal element resiliently deflects in the radial direction away from the direction of rotation toward the rim of the blade, the deflection being proportional to the gap G for gaps less than or equal to the protruding length of the seal element.

Means 78 are provided for imparting vibratory movement to the casing. The vibratory means is attached to the casing 45. An example of such a means is a rotating shaft having an oscillating imbalances imparted by the shaft by weights 98 spaced radially from the axis of rotation. The shaft is rotatably supported.

A first bracket 100 and a second bracket 102 which extend laterally from the casing. Preferably, the imbalance acts in the vertical direction to cause the casing to oscillate up and down with a vibratory motion. The vibratory movement is transmitted from the casing to the media such that the media moves with respect to an article disposed within the media and with respect to the casing.

As shown in FIG. 3, the media 30 will generate circulation patterns which are dependent on the volume of media in the chamber and occupy a region which is a function of the volume and operative conditions of the apparatus. At a given frequency for a given type of media and amplitude of vibration, media of a volume which is bounded by the region $R_1$ has a circulation pattern $C_1$. The media within the region $R_1$ is not piled so high that the volume engages the shaft of the auger.

Adding a slightly greater volume of media to a chamber causes the media to assume the outline shown in region $R_2$. Thus, the region $R_2$ contains the region $R_1$ as well and some additional volume of media. The media in region $R_2$ engages the lower half of the rotor shaft. Experience has shown that media in region $R_1$ below the shaft and in region $R_2$ below the top half of the shaft will have a circulation pattern shown by the arrows designated $Z_1$. Adding an additional amount of media to bring the volume above the bottom half of the rotor shaft makes more and more likely the establishment of a secondary circulation zone $Z_2$ (and makes it nearly certain above the shaft), as shown by the arrows marked $Z_2$. It is likely that an article disposed in the media will move from the primary circulation zone to any secondary circulation zone at the top of the media.

Figure 4:
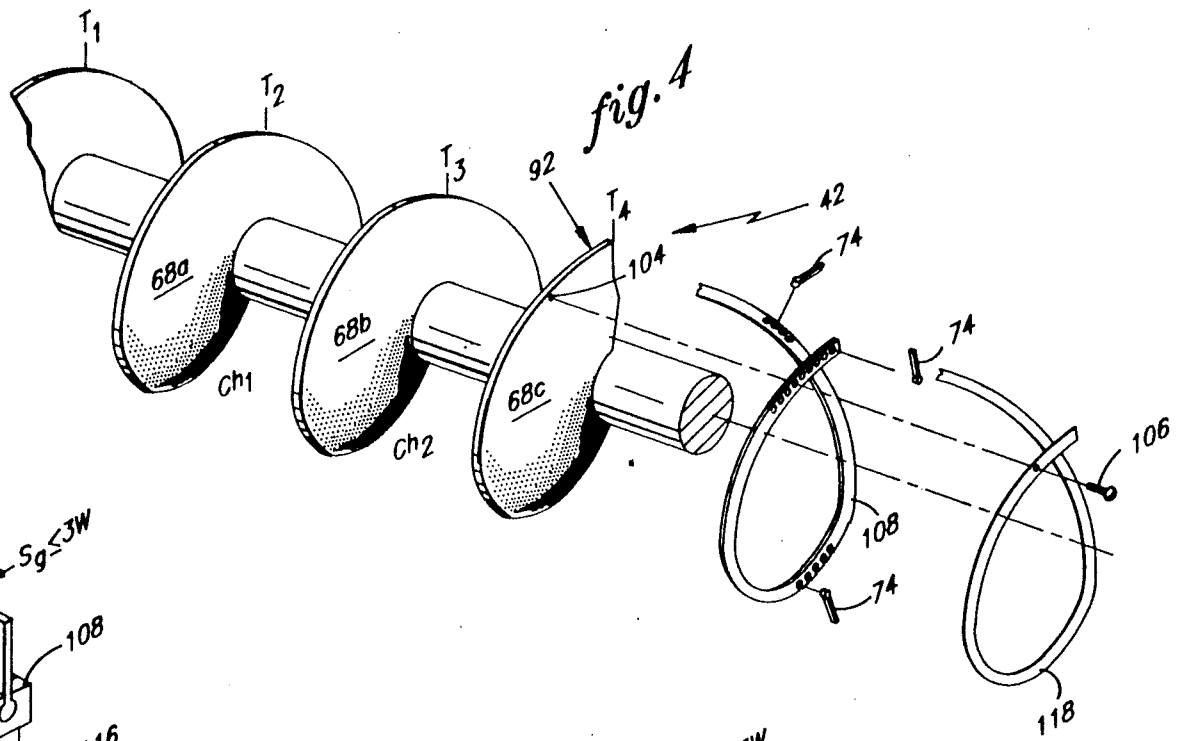
FIG. 4 is a partial perspective view in exploded fashion of a helicoid-type blade and shaft employed in the apparatus shown in FIG. 1.

FIG. 4 is a partial perspective view of the auger 42 showing the shaft 44, the helicoid-type blade attached to the shaft and four of the adjacent peaks $T_1$, $T_2$, $T_3$ and $T_4$. The blade has bottom portions 68*a*, 68*b* which bound the chamber $Ch_l$ and has bottom portions 68*b*, 68*c* between $T_2$, $T_3$ and $T_4$ which bound the chamber $Ch_2$ in the lateral direction and prevent longitudinal movement of the finishing media between adjacent chambers.

FIG. 4 also shows the rim region 92 of a portion of the blade showing the relationship of the components which form one embodiment of the resilient seal assembly 74. The rim region 92 of the blade has a plurality of holes for receiving a nut and bolt assembly at each hole, as represented by the hole 104 and the bolt 106. A seal carrier member 108 having a plurality of axially oriented slots 112 is attached to the rim.

A plurality of seal elements extend radially outwardly from the blade with one seal element at each slot, as represented by the three seal elements 74. Each seal element has a root 114 which adapts the seal element to engage an associated slot in the blade. Each seal element has a seal flap 116 of resilient material which extends radially outwardly from the root and which adapts the seal element to slidably engage the sealing region 88 of the casing which is broken away for clarity. A side plate 118 and the seal carrier member 108 axially trap the seal elements.

As will be realized, the rim region of the blade might be a one-piece construction having a plurality of slots, eliminating the need for a seal carrier. The seal elements are easily replaced by loosening the side plate, to change the spacing of seal elements or to replace worn or damaged seal elements.

Figure 5:
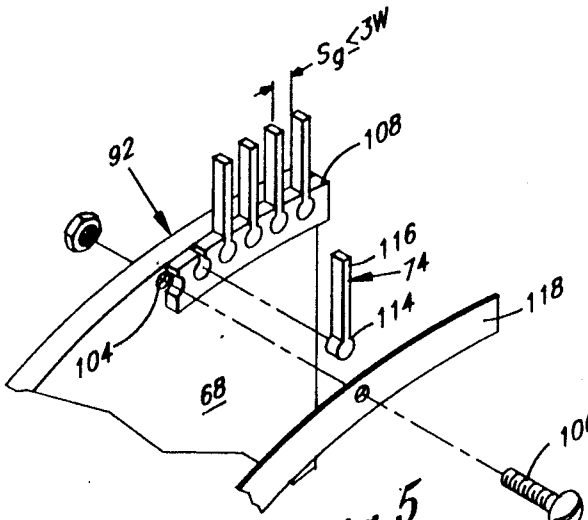
FIG. 5 is an exploded partial perspective view of the rim region of a blade showing a seal assembly.

FIG. 5 is an enlarged, exploded view of a portion of the blade 66 and seal assembly 72 shown in FIG. 3 showing the relationship of the rim region 92, the seal carrier member 108 and the side plate 118 which are attached to the rim region by the nut and bolt combination 106. The seal flaps 116 are spaced circumferentially apart one from the other leaving a circumferential gap $S_g$ therebetween.

Figure 6:
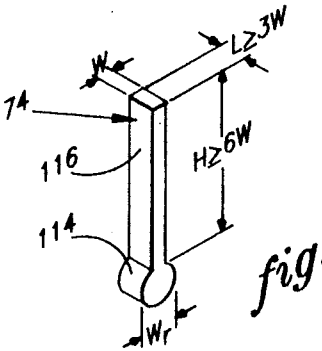
FIG. 6 is a partial perspective view of a seal element of the seal assembly.

FIG. 6 is an enlarged view of one of the seal elements 74 shown in FIG. 5. The seal flap 116 of the seal element has a width W in the circumferential direction. The spanwise height H is greater than or equal to six times the width W ($H \geqq 6W$) and in one satisfactory construction is approximately ten times the width W. The seal flap has an axial length L which is greater than or equal to three times the width ($L \geqq 3W$) and in one satisfactory construction was equal to 4W. The width $W_r$ of the root is greater than the width W of the flap. In one satisfactory embodiment, the auger 42 and casing 45 were coated with a resilient coating of Urethane available from the Ultramatic Equipment Company having a durometer hardness rating of 90. The flap material was made of a Urethane elastomeric material available from the Airex Rubber Products Corporation, 100 Indian Hill Avenue, Portland Conn., and designated as Urethane material A-6040-R. Preferably the hardness of the Urethane flap is less than the hardness of the Urethane liner of the vibratory casing and auger to minimize auger and liner surface wear.

In one embodiment, the diameter of the auger about the axis of the shaft in the rest position was approximately nineteen inches (19"). A clearance gap G of three quarters of an inch (¾") was provided between the rim region 92 of the blade and the surface of the casing in the circular section at the bottom of the casing. The expected vibration was fairly large, plus or minus one quarter of an inch in the vertical direction. Accordingly the actual operative gap between the blade and the resilient surface of the casing was expected to lie in a range of one quarter to one and a quarter inches (¼"–1¼"). The length of the flap extending from the surface of the blade was one and a quarter inches (1¼"). The circumferential spacing between adjacent flaps $S_g$ was equal to one quarter of an inch.

Figure 7:
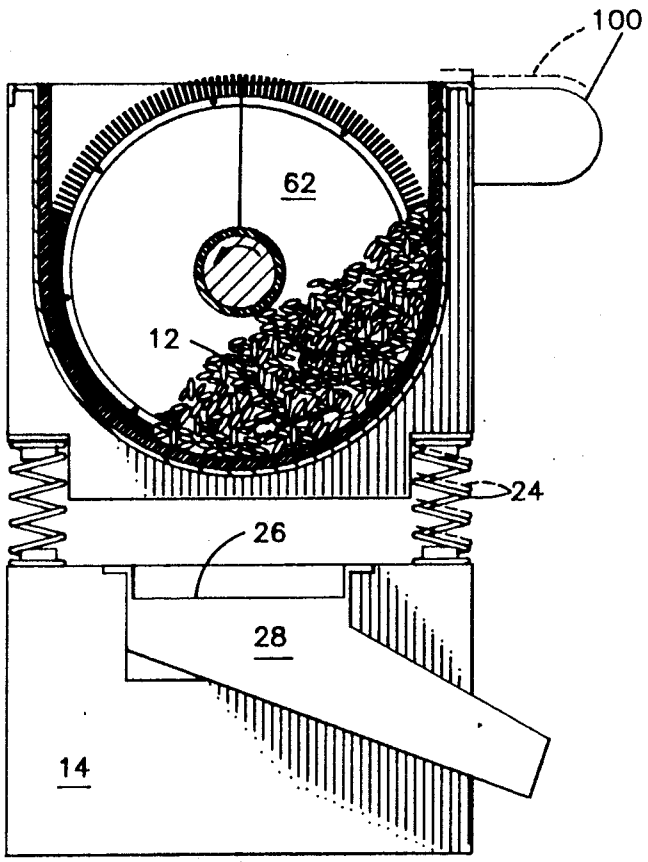
FIG. 7 is a view of the apparatus shown in FIG. 1 taken along the lines 7—7, partially broken away to show a portion of the helicoid-type blade, the resilient surface of the casing and a media disposed in the casing with a turbine blade disposed in the media.

FIG. 7 is an end view taken generally along the lines 7—7 of FIG. 1 with a portion of the apparatus 10 broken away for clarity. As shown in FIG. 7, the auger rotor is rotating about its axis at a rate of about one revolution every three to five minutes (0.2–0.33 rpm) and at the same time, the rotor shaft 96 and its eccentric weight 98 are spinning about its axis imparting a vertical movement of approximately a quarter of an inch as shown by the dotted lines in FIG. 7 and the double headed arrows which are exaggerated for clarity.

Figure 8:
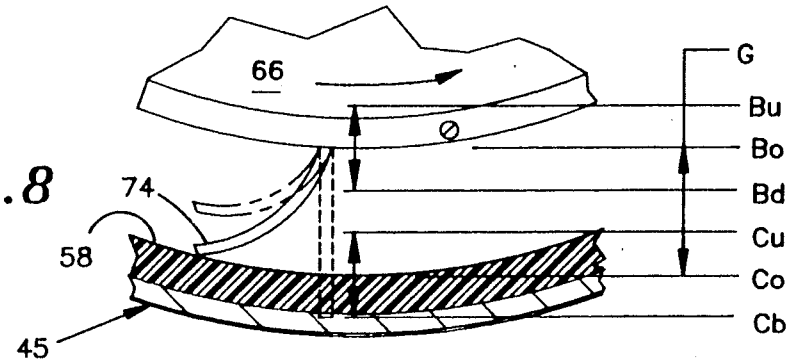
FIG. 8 is an enlarged view of a portion of the seal assembly and adjacent structure shown in FIG. 3 to show the relationship of elements of the seal assembly as the apparatus of FIG. 1 is vibrated in the vertical direction.

FIG. 8 shows the effect of relative vibrational movement of the helicoid-like blade 66 with respect to the casing inner surface 58. The blade has a rest position $B_o$ and the casing surface has a rest position $C_o$. At the rest position, the seal element is resiliently deflected as shown by the seal element in full. During a vibration of plus or minus $V_a$ from the rest positions, and as the auger vibrates at a frequency which is one hundred and eighty degrees out of phase with the casing, the casing deflects radially downwardly to position $C_b$ and the blade deflects radially upwardly to position $B_u$. At these locations for the blade and the casing, the seal element extends radially outwardly its maximum length and just touches the casing surface as shown by the seal element outlined by the dotted line. Accordingly, the seal assembly provides sealing even during the maximum clearance gap G. If the vibrations are exactly in phase, the blade moves to position $B_d$ and the casing moves to position $C_u$ leaving the minimum clearance gap G therebetween. At this location the seal element deflects even further, as shown in phantom, than the seal rest position shown in full. Even though there is a circumferential clearance $S_g$ between blades, the axially stiff seal flaps prevent media or the blade from entering the variable gap G between the blade and the casing.

The method for processing a plurality of articles includes disposing successive predetermined volumes of the carrier media 30 on the inner surface of the casing 58. Each volume of media is adapted to carry at least one turbine blade in the finishing media. The inner surface of the casing is a supporting surface for the media and for the turbine blade it carries. The finishing media is adapted by its contour to provide the required surface finish to the article, that is, finish edges and surfaces. One satisfactory media for turbine blades is made of silicon carbide material shaped as angle cut triangles, which are face contoured at sixty degrees (60°) and this is available from U-M Abrasives, Inc., Kennedale, Tex., as Part PMC-3186-1. Preferably, one rotor blade is disposed in each successive volume of carrier media for carrying the rotor blade in a predetermined, spaced apart relationship to the turbine blades in the adjacent volumes of media.

As the auger 42 is turned, the resilient surface 62 of the helicoid-type blade 66 acts as an inclined plane exerting an axial force against the media, forcing the media to travel its predetermined path along the resilient inner surface 58 of the casing 55. Each volume of media is trapped in its chamber Ch by the helicoid-type blade and by the flexible seal assembly 72 which extends between the blade and the inner surface of the casing.

As vibratory motion is imparted to the casing 45 and thence to the media 30, the media moves with respect to the casing and to the turbine blade. The vibratory motion causes the media to follow the circulation zone $Z_1$ for the volumes of media in regions $R_1$ and $R_2$. The turbine blade 12, which was initially placed on top of the media in the hopper 34, begins to move into the media following the circulation in zone $Z_1$. The amount of work done on the turbine blade is proportional to the pressure exerted by the media and thus to the height (or head) of media above the turbine blade. As the turbine blade reaches the bottom of the circulation zone $Z_1$ of region $R_1$, the maximum amount of work is done on the turbine blade. As the turbine blade moves up toward the top of the circulation zone, less work is done because the height (and weight of media on the turbine blade) of the media is decreasing. Then, the media and turbine blade circulate downwardly into the bottom of region $R_1$ where the maximum amount of work is done on the turbine blade.

The amount of work done on a surface is proportional to the frictional force acting on the surface. The frictional force is proportional to pressure. Accordingly, sharp edges are quickly ground down because of their small surface areas whereas large surface areas experience a small removal of material.

Filling the chamber with a volume of media which lies within the region $R_3$ overfills the chamber and is almost certainly going to cause the creation of a recirculation zone as shown by the arrows $Z_2$. Experience has shown the secondary recirculation zone may capture the turbine blades as the turbine blade moves up to the top of circulation zone $Z_1$. After the turbine blade moves into the secondary circulation zone $Z_2$, the turbine blade remains in the secondary circulation zone $Z_2$ and receives very little work because of the significantly smaller height of the secondary circulation zone. A blade which remains in the secondary circulation zone will have an unsatisfactory surface finish.

Fluid is flowed into each of the chambers Ch and drains through the media into each chamber. the fluid carries finishing compound, which acts as a soap to clean the finishing media. The fluid carries fine bits of finishing media which result from media wear and bits and slivers of metal from the turbine blade. As the fluid drains to the bottom of the chamber, the fluid is urged axially along by the auger. The fluid is also able to flow between the seal members in the gap $S_g$ near the root of the seal elements, providing a second path for removing this waste material from the processing apparatus.

A particular advantage of the present invention is that each turbine blade is isolated from the adjacent turbine blades by the bottom sides of the helicoid-type blade, the seal assembly and the inner surface of the casing. Thus, each turbine blade is individually processed even though a plurality of turbine blades are flowing through the finishing apparatus.

Another advantage of the process is the turbine blade is transported between two locations in a flow line as the turbine blade is being finished by a predetermined amount of carrier media. This makes for an efficient operation, utilizing the finishing process as the transportation process for the blade and the transportation process as the finishing process for the turbine blade as it moves through an automatic flow line.

As will be realized the present method of serially finishing and transporting a plurality of turbine blades is particularly suitable for use with automatic feeding and removal operations such as might be encountered in automated flow lines for fabricating turbine blades or other articles.

Another advantage of this process is the quality of the finish on each turbine blade which results from avoiding one turbine blade striking an adjacent blade as occurs in operations in which there is no segregation of turbine blades from the adjacent blades. In addition, quality is enhanced by maintaining the height of media at a constant amount and results from finishing the blade in a predetermined volume of media. The segregation of the blades is accomplished with no decrease in the efficiency of the process and avoids time consuming removal operations or shut downs of the machines as a first batch of turbine blades are removed from the finishing media and a new batch of turbine blades are disposed in the media.

Although the invention has been shown and described with respect to detailed embodiment thereof, it should be understood by those skilled in the art that various changes in form and detail thereof may be made without departing from the spirit and scope of the claimed invention.

We claim:

1. A method of processing a plurality of articles which are supported by a screw conveyor as the articles are moved between a first location and a second location, the screw conveyor having a first surface for supporting the articles, an auger having a shaft and a blade which is attached to the shaft, the blade having a second surface and a circumferentially continuous spiral-like groove bounded by the first surface to form a series of chambers each containing a volume of media, the first surface and the second surface being resilient, which comprises:

disposing successive volumes of carrier media on the first supporting surface at the first location, each volume of media containing particles which have a mass and a surface having a coefficient of friction with respect to the article, each volume of media being separated from the adjacent volume of media and being means for carrying at least one article and for providing a surface finish to the article;

disposing an article in each successive volume of carrier media for carrying the article in spaced apart relationship to articles in the adjacent volumes of media;

urging the media as separate volumes along a predetermined path on the supporting surface which extends between the first location to the second location by rotating the blade about its axis of rotation and blocking the media of each volume from moving into an adjacent volume of media while permitting the flow of fluid through and between volumes of media;

vibrating the media with respect to the article as the media is urged along the path to cause the media to strike the article and apply a force to the article;

flowing fluid through the media to carry away media particles and particles of the article from the volume of media; and separating the article from the media at the second location;

wherein the article receives a surface finish while being transported between the first and second locations and wherein the step of disposing successive volumes of carrier media on the supporting surface includes the step of metering the volume of carrier media such that the chamber is partially filled to an extent that avoids the formation of secondary recirculation zones above the shaft of the auger as the media moves upwardly along the side of the casing in response to vibratory forces acting on the media.

2. The method of processing a plurality of articles of claim 1 wherein the step of metering the volume of media includes the step of limiting the volume of media such that during operating conditions the media does not contact the upper half of the shaft.

3. The method of processing the plurality of articles as set forth in claim 1, wherein the step of disposing an article in each successive volume of carrier media is disposing only a single article in each successive volume of carrier media.

4. The method of processing the plurality of articles as set forth in claim 1 which further includes the step of carrying the separated media to the surface as a new volume such that the media is repeatedly used to carry successive articles of the plurality of articles.

5. An apparatus for successively processing a plurality of articles which are supported by a screw conveyor as the articles are moved between a first location and a second location, the screw conveyor having a first surface for supporting the articles, an auger having a shaft and a blade which is attached to the shaft, the blade having a second surface and a circumferentially continuous spiral-like groove bounded by the first surface to form a series of chambers each containing a volume of media, the first surface and the second surface being resilient, which comprises;

means for disposing successively separate volumes of media on the first supporting surface at the first location, each volume of media containing particles which have a mass and a surface having a coefficient of friction with respect to the article, each volume of media being separated from the adjacent volume of media and being means for carrying at least one article and for providing a surface finish to the article;

means for disposing an article in each successive volume of carrier media for carrying the article in spaced apart relationship to articles in the adjacent volumes of media;

means for urging the media as separate volumes along a predetermined path on the supporting surface which extends between the first location to the second location which includes means for rotating the blade about its axis of rotation and means for blocking the media of each volume from moving into an adjacent volume of media and means for permitting the flow of fluid through and between volumes of media;

means for vibrating the media with respect to the article as the media is urged along the path to cause the media to strike the article and apply a force to the article;

means for flowing fluid through the media to carry away media particles and particles of the article from the volume of media;

means for separating the article from the media; wherein the means for disposing successive volumes of carrier media on the supporting surface includes means for metering the volume of carrier media such that the chamber is partially filled to an extent that avoids the formation of secondary recirculation zones above the shaft of the auger as the media moves upwardly along the side of the casing in response to vibratory forces and acting on the media and wherein the article receives a surface finish while being transported between the first and second locations.

6. The apparatus for processing a plurality for articles of claim 5 wherein the means for metering the volume of media includes means for limiting the volume of media such that during operating conditions the media does not contact the upper half of the shaft.

7. An apparatus having finishing media for applying a finish to a plurality of articles, the apparatus having a first end at a first location and a second end at a second location, which comprises:

a base;

a plurality of springs extending from the base for engaging a casing to resiliently support the casing from the base;

a screw conveyor spaced from the base which has an auger for urging media from a first location to a second location, the auger having a shaft which has an axis of rotation $A_r$, an upper half and a lower half and a helicoid-like blade integral with the shaft having a plurality of crests and a spiral-like groove which extends between the crests of the blade, the portion of the bottom of the blade between each crest and the next two adjacent crests and the bottom portion of the casing defining a plurality of separate chambers;

a longitudinally extending casing spaced from the base having a first side wall and a second side wall, a bottom section extending circumferentially from the first side wall to the second side wall about the axis over an arc which is less than or equal to one-hundred and eighty degrees, a first end section at the first end and a second end section at the second end, each attached to the side sections and the bottom section to form an open trough-like casing for receiving finishing media, the casing having an inner surface formed by a coating of resilient material;

a resilient seal assembly extending in a generally radially direction from the auger between the blade and the inner surface of the chamber to engage the portion of the casing which permits passage of fluid and pulverized media between small openings and which blocks the movement of media between one chamber and the adjacent chamber;

a predetermined volume of finishing media disposed in each chamber, the media containing particles having a mass and a surface having a coefficient of friction with respect to the article and being means for carrying an article, the volume of media being such that during the vibratory operative condition the media circulates within each chamber but does not contact the upper half of the shaft;

an article disposed in the finishing media for carrying by the finishing media;

a discharge opening for discharging the media and article onto a moving screen;

a moving screen having openings which are sized to pass the media and trap the blade;

a conveyor for receiving media for returning the finishing media to the inlet of the screw conveyor;

means for imparting vibratory movement to the casing and thence to the media such that the media moves with respect to the article and with respect to the casing up toward one of the sidewalls of the tub in the direction of rotation of the auger;

wherein vibration of the carrier causes circulation of the media within the chamber, the media moving up the bottom section of the casing toward the sidewall and falling back toward the bottom section of the casing imparts a rotational force to the auger.

* * * * *